US007180482B2

(12) United States Patent
Homma

(10) Patent No.: US 7,180,482 B2
(45) Date of Patent: Feb. 20, 2007

(54) METHOD FOR DRIVING PLASMA DISPLAY PANEL

(75) Inventor: Hajime Homma, Tokyo (JP)

(73) Assignee: Pioneer Corporation, Tokyo-To (JP)

( * ) Notice: Subject to any disclaimer, the term of this patent is extended or adjusted under 35 U.S.C. 154(b) by 56 days.

(21) Appl. No.: 09/992,052

(22) Filed: Nov. 23, 2001

(65) Prior Publication Data

US 2002/0063663 A1 May 30, 2002

(30) Foreign Application Priority Data

Nov. 24, 2000 (JP) ..... 2000-358138

(51) Int. Cl.
*G09G 3/28* (2006.01)
*G09G 3/10* (2006.01)

(52) U.S. Cl. ..... 345/66; 345/67; 345/68; 345/690; 315/169.1; 315/169.4

(58) Field of Classification Search ..... 345/60–63, 345/66, 68, 690, 692, 87–89, 99; 315/169.1–169.4, 315/169

See application file for complete search history.

(56) References Cited

U.S. PATENT DOCUMENTS 5,541,618 A * 7/1996 Shinoda ..... 345/60
5,835,072 A * 11/1998 Kanazawa ..... 345/60
5,877,734 A * 3/1999 Amemiya ..... 345/60
6,384,802 B1 * 5/2002 Moon ..... 345/60
6,559,814 B1 * 5/2003 Kanazawa et al. ..... 345/60
6,836,261 B1 * 12/2004 Kishi et al. ..... 345/60
7,023,406 B1 * 4/2006 Nunomura et al. ..... 345/63

FOREIGN PATENT DOCUMENTS

JP 2674485 7/1997

* cited by examiner

*Primary Examiner*—Henry N. Tran
(74) *Attorney, Agent, or Firm*—Drinker Biddle & Reath LLP

(57) ABSTRACT

A method for driving a plasma display panel in which any one of a scanning electrode and a sustaining electrode is shared by neighboring display cells interposed therebetween. At least one condition selected from the group consisting of a voltage of a sustaining pulse, a pulse width of a sustaining pulse, and a pulse applying interval of a sustaining pulse is changed in relation to a polarity of the sustaining pulse. The sustaining pulse is applied to the scanning electrode and sustaining electrode by a predetermined number with relation to an image data during a sustaining period.

19 Claims, 14 Drawing Sheets

METHOD FOR DRIVING PLASMA DISPLAY PANEL

BACKGROUND OF THE INVENTION

1. Field of the Invention

The present invention relates to a method for driving a plasma display panel in which any one of the sustaining electrode and scanning electrode is used commonly by the cells next to both sides thereof.

2. Description of the Related Art

Generally, plasma display panels are characterized in that they have a thin structure; almost no blinking or flickering occurs; they have a high display contrast; it is possible to have a relatively large screen area; they have a fast response speed; and they are of self-luminous type enabling emission of the multi-colored light by using fluorescent materials. Therefore, in recent years plasma display panels have been used extensively in the computer-related display device field, color-image display field, and the like.

According to the method of operation, the plasma display panels are classified into AC-type plasma display panels that are run in the alternating current discharge mode indirectly as the electrodes are coated with a dielectric substance and DC-type plasma display panels that are run in the direct current discharge type as the electrodes are exposed to the discharging space. The AC-type plasma display panels are further classified into those of memory-run type using the display cell memory and those of refresh-run type not using the display cell memory according to the method of driving. Also, brightness of the above refresh-run-type plasma display panels is lowered if the display capacity is increased. This is because brightness of plasma display panels is proportional to the frequency of discharge. For that reason, the memory-run-type plasma display panels are used mainly when running the highly bright and large-capacity display.

FIG. 1 is a perspective diagram of the relevant parts of the AC-type plasma display panel structure which is a first conventional art.

A pair of glass substrates (a front substrate 101 and a rear substrate 102) facing to each other is installed in the AC-type plasma display panel. Transparent sustaining electrodes 103, transparent odd-numbered scanning electrodes 104*a*, and transparent even-numbered scanning electrodes 104*b* are installed at the side, facing the rear substrate 102, of the front substrate 101. The sustaining electrodes 103, odd-numbered scanning electrodes 104*a*, and even-numbered scanning electrodes 104*b* are extended in the horizontal direction of the panel. Trace electrodes 106 are positioned to overlap with the sustaining electrode 103, odd-numbered scanning electrode 104*a*, and even-numbered scanning electrode 104*b*, respectively. The trace electrode 106 is made of a metal, for example, and is provided in order to reduce the electrode resistance value between each electrode and the external driving device. Also installed is a dielectric layer 112 covering the sustaining electrodes 103, odd-numbered scanning electrodes 104*a*, and even-numbered scanning electrodes 104*b*. A protective layer 114 composed of magnesium oxide protecting the dielectric layer 112 from being discharged is further provided.

At the side, facing the front substrate 101, of the rear substrate 102, data electrodes 107 which intersect at right angle with the sustaining electrodes 103 and scanning electrodes 104*a* and 104*b* are installed. Accordingly, the data electrodes 107 are extended in the vertical direction of the panel. Also installed on the data electrodes 107 is a dielectric layer 113 covering the data electrodes 107. Further, partition walls 109 separating the display cell in the horizontal direction are installed on the dielectric layer 113. Still further, fluorescent layers 111 converting the ultraviolet light, which is emitted by discharging of gases, into the visible light are formed on the side surfaces of the partition walls 109 and on the surface of the dielectric layer 113. Spaces for discharge gases 108 are secured between the front substrate 101 and rear substrate 102 with the partition walls 109. The discharge gas such as helium, neon, xenon, etc. or their mixture is filled into the spaces 108.

The display lines are formed between a scanning electrode and a sustaining electrode in the plasma display panel. In the meantime, all sustaining electrodes are shorted and called the common electrodes as the same waveform is applied to all sustaining electrodes. Such structure is referred to as an SC structure hereinafter.

Next, the memory-run-type driving operation in the plasma display panel having the above-described SC structure is described below.

FIG. 2 is a timing chart of sequence showing the writing-selective-type driving operation of the conventional plasma display panel. In this sequence one sub-field is composed of four periods including a priming period, addressing period, sustaining period, and sustainment-erasing period which are set sequentially.

First, in the priming period, the sawtooth-wave priming pulse Ppr-s is applied to the scanning electrodes and the rectangular-wave priming pulse Ppr-c is applied to the sustaining electrodes. The sustaining pulse voltage Vs is the reference potential of all pulses in this specification. The voltage pulse which is lower than the sustaining pulse voltage Vs is referred to as the negative polarity pulse, and the voltage pulse which is higher than the sustaining pulse voltage Vs is referred to as the positive polarity pulse.

The priming discharge occurs between the scanning electrode and sustaining electrode as the priming pulses Ppr-s and Ppr-c are applied thereto. As a result, active particles that facilitate the sustaining discharge of the cells thereafter are produced, wall charges with negative polarity is generated on the scanning electrodes, and wall charges with positive polarity is generated on the sustaining electrodes. Subsequently, the charge adjustment pulse Ppe-s is applied to the scanning electrodes. As a result, weak discharging occurs, and the negative polarity wall charges on the scanning electrodes and the positive polarity wall charges on the sustaining electrodes are reduced.

The next addressing period is the selection period of display cells that emit the light. During the addressing period, Pbw-s as the reference voltage is applied to the scanning electrodes and the scanning pulse Puw-s is applied to in the scanning sequence. Also, the data pulses Pd are applied to the data electrodes according to an image data.

The data pulse Pd is a pulse for selecting display cells. If the scanning pulse Puw-s and data pulse Pd are synchronized with each other, the writing discharge occurs at the intersection of the corresponding scanning electrode and data electrode. In the display cell with the writing discharge occurred, wall charges with positive polarity are generated on the scanning electrode, and wall charges with negative polarity are generated on the sustaining electrode. Whereas, in the display cell without the writing discharge occurred, the charging arrangement state when the charge adjustment pulse Ppe-s is applied to in the priming period is maintained.

The sustaining period after the addressing period is a period for display luminescence. During the sustaining period, application of the sustaining pulses from the sustaining electrodes side are initiated, after which the sustaining pulses Psus-s and Psus-c with negative polarity are applied to the scanning electrodes and sustaining electrodes with the sustaining pulse voltage Vs alternately. At this time, no sustaining discharge occurs even when the sustaining pulses are applied to the display cell, because the amount of wall charges of the display cell where writing is not performed during the addressing period is extremely small. In the meantime, in the display cell with the writing discharge occurred during the addressing period, the sustaining pulse voltage with negative polarity to the sustaining electrodes and wall charge voltage are superposed, and discharging occurs as the voltage between the electrodes exceeds the initial discharging voltage since the positive wall charges are remained on the scanning electrode and the negative wall charges are remained on the sustaining electrode. The sustaining pulse which is applied to initially is set to have a greater pulse width compared to that of the sustaining pulses that are continued thereafter so as to ensure sustaining discharge of the display cell which is selected during the addressing period as disclosed in Japanese Patent No. 2,674,485.

Once discharge occurs, the wall charges are positioned to counteract the voltage that is applied to each electrode. Therefore, the negative charges are generated on the sustaining electrode, while the positive charges are generated on the scanning electrode. Since the next scanning pulse becomes the positive-voltage pulse at the scanning electrode side, the effective voltage that is applied to the discharging space by superposing it with the wall charges exceeds the initial discharging voltage thus generating discharge. Therefore, in the same way, discharge is maintained as the periods that are shown to be "a" and "b" in FIG. 2 are repeated. Brightness of each sub-field is determined according to the frequency of repetition of discharging.

Finally, during the sustainment-erasing period, the sustaining erasing pulses Pse-s with negative polarity are applied to the scanning electrodes. The negative polarity sustaining erasing pulses Pse-s are the sawtooth-wave pulse. Then, the wall charges that are generated on each electrode in case that the sustaining discharge is being executed are cancelled and discharging is stopped.

In actual driving, the gradation display is achieved as a multiple number of sub-fields having different luminous intensities are combined to form one field by varying the number of sustaining pulses when the time from the priming period to the sustainment-erasing period is set to be one sub-field as shown here.

FIG. 3 is a perspective diagram of relevant parts of the AC-type plasma display panel structure which is a second conventional art. The same reference numerals are given to the compositional elements of the second conventional art shown in FIG. 3 as those given to the first conventional art shown in FIG. 1, and their duplicate illustration is omitted.

In the plasma display panel of the SC structure shown in FIG. 1, there are always at least two trace electrodes in the display cell. These trace electrodes lower brightness as they cut off the display light. A structure in which one sustaining electrode is shared by two vertically connected cells in order to reduce the number of trace electrodes is disclosed in Japanese Patent Laid-Open Publication No. Hei. 2-226639. Hereinafter, a structure in which one sustaining electrode is shared is referred to as an SCS structure in this specification.

In the second conventional art, the SCS structure is adopted. FIG. 4 is a schematic diagram showing the layout of electrodes in the SCS structure.

As shown in FIG. 4, the SCS structure is basically the same as the SC structure except that the sustaining electrode is shared by the upper display cell and lower display cell. However, it is possible to obtain a high brightness since the area occupied by the trace electrodes that cut off the display light is ¾ of the SC structure.

FIGS. 5A and 5B are schematic diagrams showing that only one line is emitted between the odd-numbered scanning electrode and sustaining electrode in the conventional driving sequence in the plasma display panel of the SCS structure. FIG. 5A shows the mode of emission during the period a in FIG. 2, i.e., during the period when the sustaining electrode is positive, and FIG. 5B shows the mode of emission during the period b in FIG. 2, i.e., during the period when the sustaining electrode is negative. As shown in FIGS. 5A and 5B, the range of emission when the sustaining electrode is negative is different from that when the sustaining electrode is positive. That is, emission of the light is expanded beyond the trace electrode of the sustaining electrode when the sustaining electrode is negative, but emission of the light is not expanded beyond the trace electrode of the scanning electrode when the sustaining electrode is positive, provided that it looks as if emission of the light were expanded to the sustaining electrode side a little since emission of the light of both polarities is added up and viewed actually.

The reason for wide expansion of emission of the light at the negative polar side is the property of discharging that emission of the light is stronger near the negative electrode in the negative glow region since the ultraviolet light by discharging of the negative glow occurred in the negative electrode is used mainly in the plasma display panel.

In the meantime, the cells emitted in the odd-numbered field is different from those emitted in the even-numbered field if the plasma display panel is run in the interlace mode. That is, only the display cells including the odd-numbered scanning electrode are emitted in the odd-numbered field, and only the display cells including the even-numbered scanning electrode are emitted in the even-numbered field.

FIG. 6 is a schematic diagram showing the mode of emission of each display cell in the interlace mode. The cells with hatching are the cells that can emit light in FIG. 6.

FIG. 7 shows the case where the plasma display panel of the SCS structure shown in FIG. 3 is operated in accordance with the waveform shown in FIG. 2 in the progressive mode. That is, the sustaining discharge is performed between the odd-numbered scanning electrode and sustaining electrode and between the even-numbered scanning electrode and sustaining electrode in the same field.

FIGS. 8A and 8B are schematic diagrams showing the mode of emission when the progressive mode is adopted in the plasma display panel of the SCS structure. FIG. 8A shows the mode of emission during the period a in FIG. 2, i.e., during the period when the sustaining electrode is positive, while FIG. 8B shows the mode of emission during the period b in FIG. 2, i.e., during the period when the sustaining electrode is negative. The sustaining electrode is negative and the sustaining pulse is applied to in the period b in FIG. 2. As shown in FIG. 8B, the range of emission between the odd-numbered scanning electrode and sustaining electrode is superposed with that between the sustaining electrode and even-numbered scanning electrode at the upper and lower portions of the sustaining electrode.

As described above, emission of the light by the sustaining discharge is expanded to neighboring cells on the shared electrode if the plasma display panel of the SCS structure is run in the conventional method. For this reason, emission of the light at the boundary of display lines sharing the sustaining electrode becomes stronger, and it looks as if the display lines existed continuously at an interval of two lines. This lowers the vertical resolution, making the quality of images undesirable.

If the display cells including the odd-numbered scanning electrode emit the light, the mode of emission of the light of each display cell is the same as that shown in FIGS. 5A and 5B, for example, and emission of the light is expanded to neighboring cells while the sustaining electrode becomes negative. Also, in the even-numbered field, emission of the light is expanded to neighboring cells on the sustaining electrode. In the interlace mode, emission of the light of the cells that are next to each other up and down is separated in view of the time, but actually, emission of the light of the odd-numbered field and even-numbered field is added and viewed. For this reason, the vertical resolution is lowered as in the progressive mode.

Also, in the progressive mode, if any one side of the sustaining electrode is selected, emission of the light is expanded to neighboring cells, but if both sides of the sustaining electrode are selected, emission of the light is offset that much. For that reason, brightness per cell of the corresponding cell is changed according to the state of selection of neighboring cells. Further, the above problem occurs simultaneously if the interlace method is mixed with the progressive method. Still further, brightness per area on an average is lowered in the same discharging frequency since the number of display cells that emit the light in the same time in the interlace method is ½ of that in the progressive method irrespective of the panel structure.

SUMMARY OF THE INVENTION

It is an object of the present invention to provide a method for driving a plasma display panel that can suppress lowering of brightness in the interlace method while still improving the vertical resolution.

According to one aspect of the present invention, a method for driving a plasma display panel in which any one of a scanning electrode and a sustaining electrode is shared by neighboring display cells interposed therebetween comprises the step of changing at least one condition selected from the group consisting of a voltage of a sustaining pulse, a pulse width of a sustaining pulse, and a pulse applying interval of a sustaining pulse in relation to a polarity of the sustaining pulse, the sustaining pulse being applied to the scanning electrode and sustaining electrode by a predetermined number with relation to an image data during a sustaining period.

According to another aspect of the present invention, a method for driving a plasma display panel in which any one of a scanning electrode and a sustaining electrode is shared by neighboring display cells interposed therebetween comprises the step of assigning one or more sub-fields with an interlace method in which lines emitting light are changed in each field, and one or more sub-fields with a progressive method in which all lines emit light, in a plurality of sub-fields constituting one field.

According to further another aspect of the present invention, a method for driving a plasma display panel in which any one of a scanning electrode and a sustaining electrode is shared by neighboring display cells interposed therebetween comprises the step of executing sustaining discharge of the neighboring display cells at an interval of one cycle alternately.

The present invention is effective as follows.

Firstly, it is possible to improve the brightness as well as luminous efficiency in the interlace method. This is because brightness may be increased without increasing the electric power inputted by expanding discharge to the direction of an electrode not emitting the light since only one of upper and lower portions of the electrode shared by the odd-numbered field and even-numbered field emits the light in the interlace method. This enables improvement of brightness as well as luminous efficiency.

Secondly, it is possible to improve the vertical resolution in both interlace method and progressive method. This is because it is possible to express dark lines vividly between the light emission units by reducing the range of emission when the shared electrode is negative if the upper and lower portions of the shared electrode emit the light at the same time. Also, in the interlace method, it is possible to select one characteristics between good resolution and high brightness according to the purpose of display.

Thirdly, if one field is comprised of a sub-field for interlace method and a sub-field for progressive method, it is possible to improve brightness, luminous efficiency, and vertical resolution at the same time by adopting the above first and second effects according to the method of driving.

DETAILED DESCRIPTION OF THE PREFERRED EMBODIMENT

Figure 1:
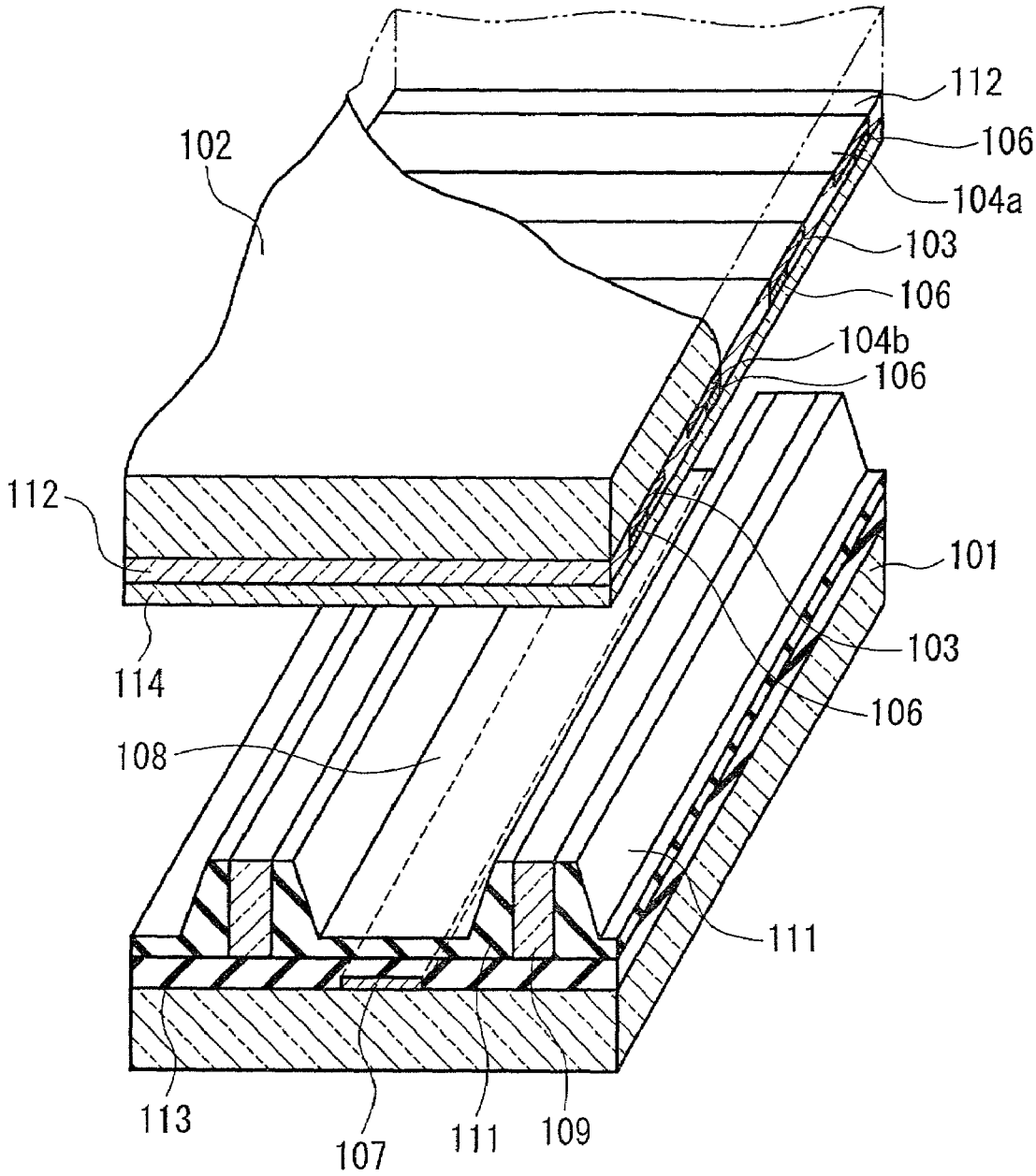
FIG. 1 (PRIOR ART)
FIG. 1 is a perspective diagram of the relevant parts of the AC-type plasma display panel structure which is a first conventional art.
Figure 2:
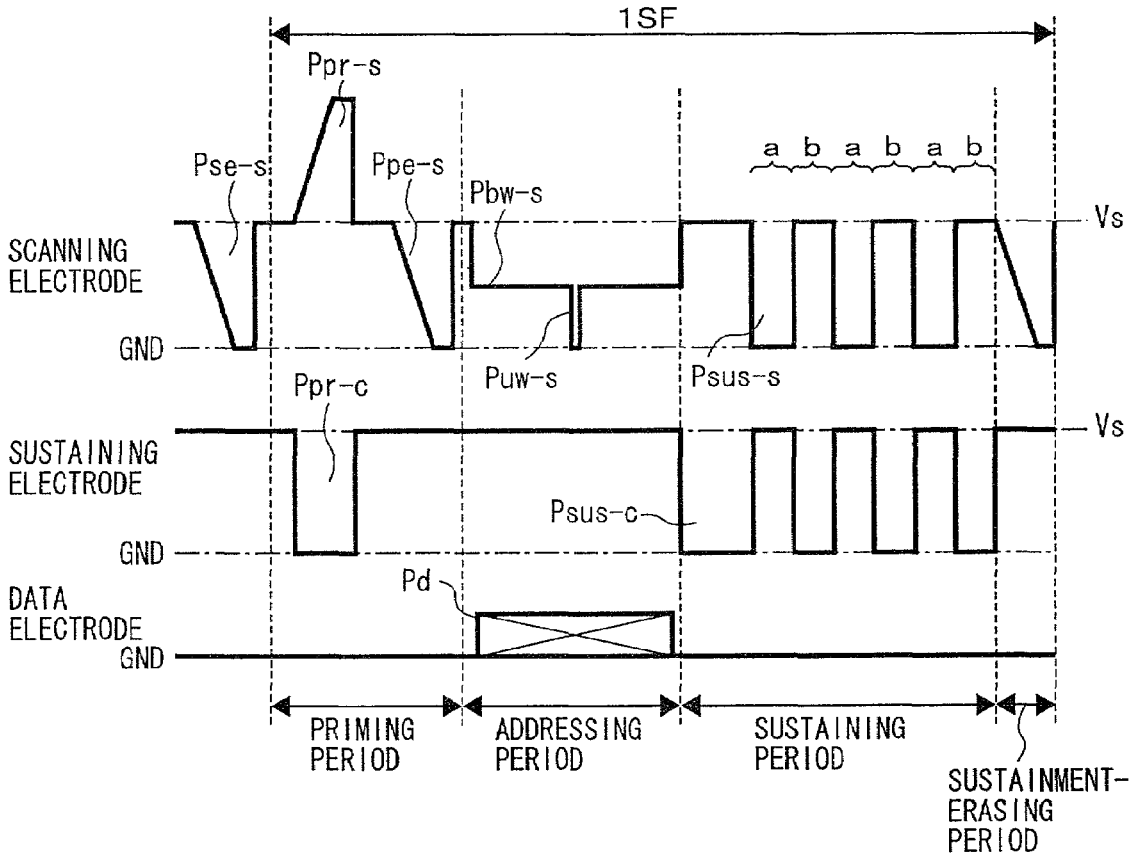
FIG. 2(PRIOR ART)
FIG. 2 is a timing chart of sequence showing the writing-selective-type driving operation of the conventional plasma display panel.

Referring now to the drawings, preferred embodiments of the present invention will be described in more detail.

Figure 3:
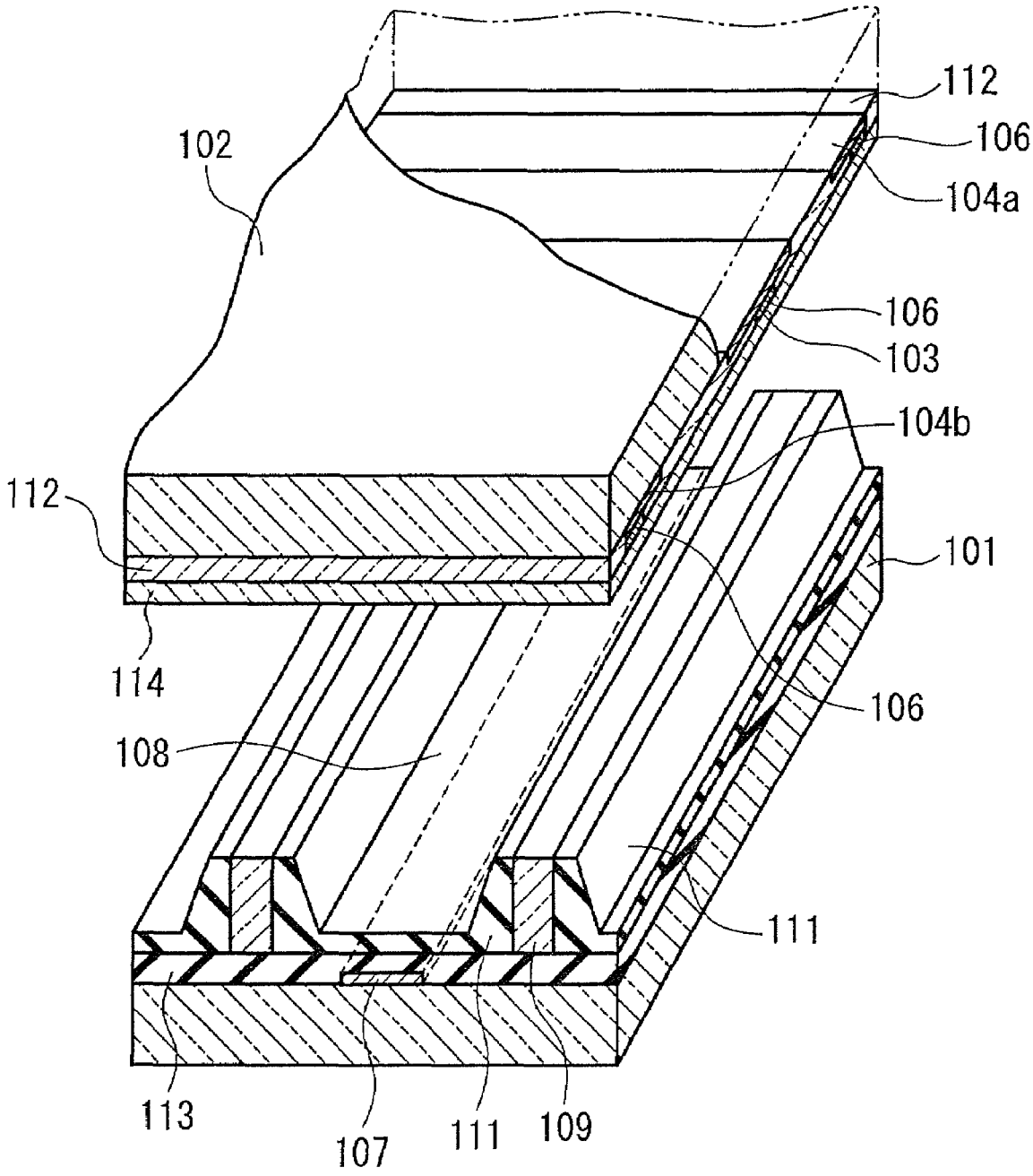
FIG. 3(PRIOR ART)
FIG. 3 is a perspective diagram of relevant parts of the AC-type plasma display panel structure which is a second conventional art.
Figure 4:
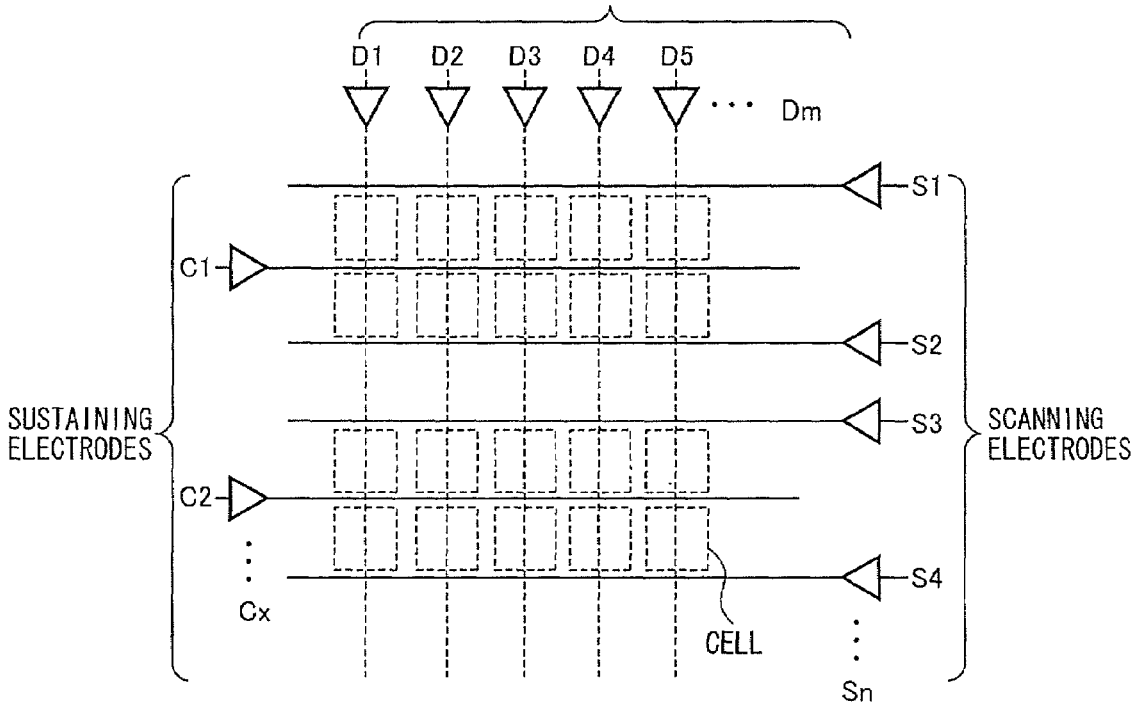
FIG. 4(PRIOR ART)
FIG. 4 is a schematic diagram showing the layout of electrodes in the SCS structure.
Figure 9:
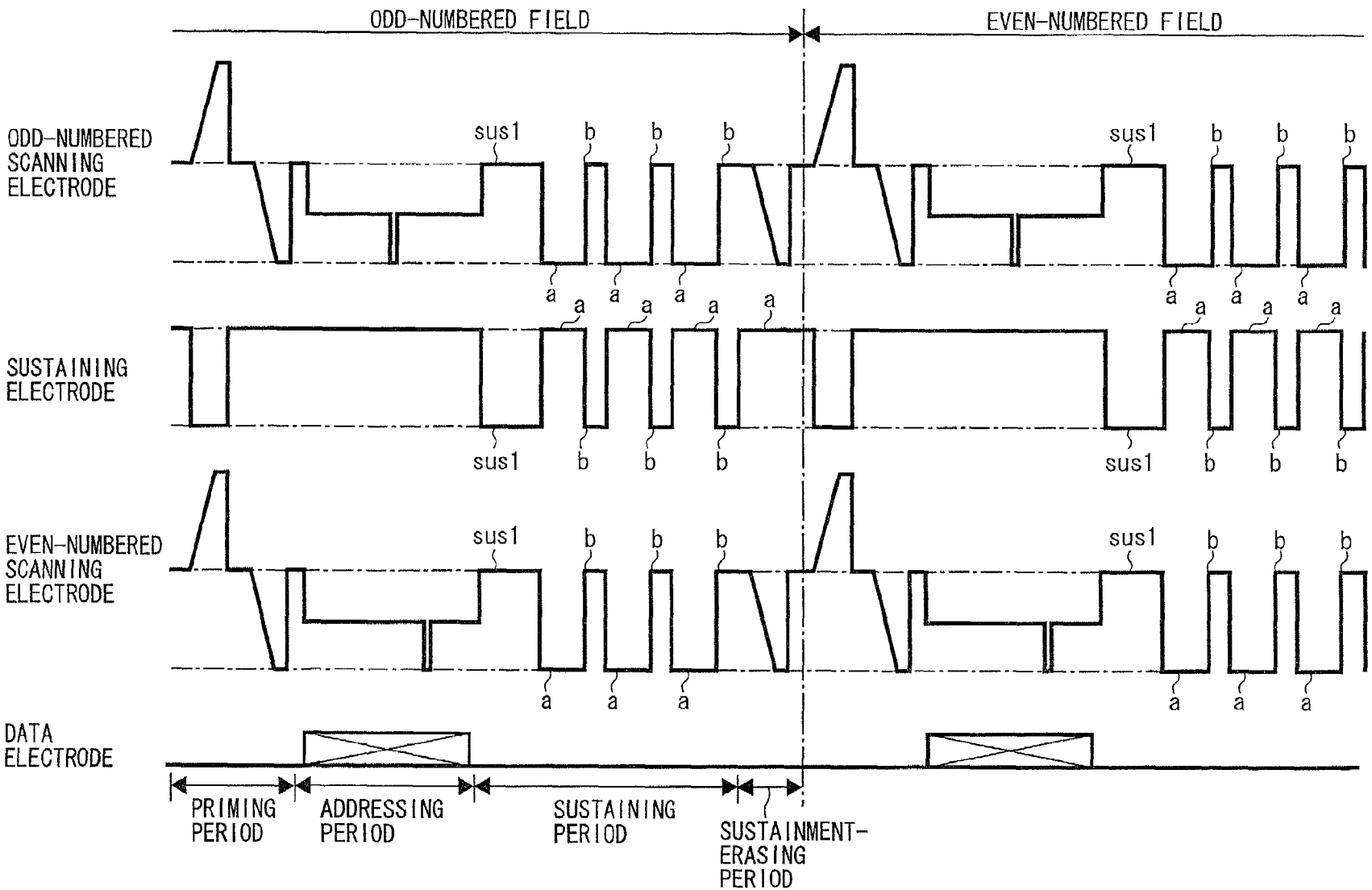
FIG. 9 is a timing chart showing a method for driving a plasma display panel in a first embodiment of the present invention.

FIG. 9 is a timing chart showing a method for driving a plasma display panel in a first embodiment of the present invention, in which the plasma display panel of the SCS structure shown in FIG. 3 is the subject of interlace method.

During the addressing and sustaining periods, the pulses are applied only to the scanning electrode at the light emitting side. The sustaining pulse in which the sustaining electrode is positive is shown to be a, and that in which the sustaining electrode is negative is shown to be b. In the present embodiment, as shown in FIG. 9, the pulse width of sustaining pulse b in which the sustaining electrode is negative is set to be narrower than that of sustaining pulse a in which the sustaining electrode is positive except for the first sustaining pulse sus1.

Figures 10A, 10B:
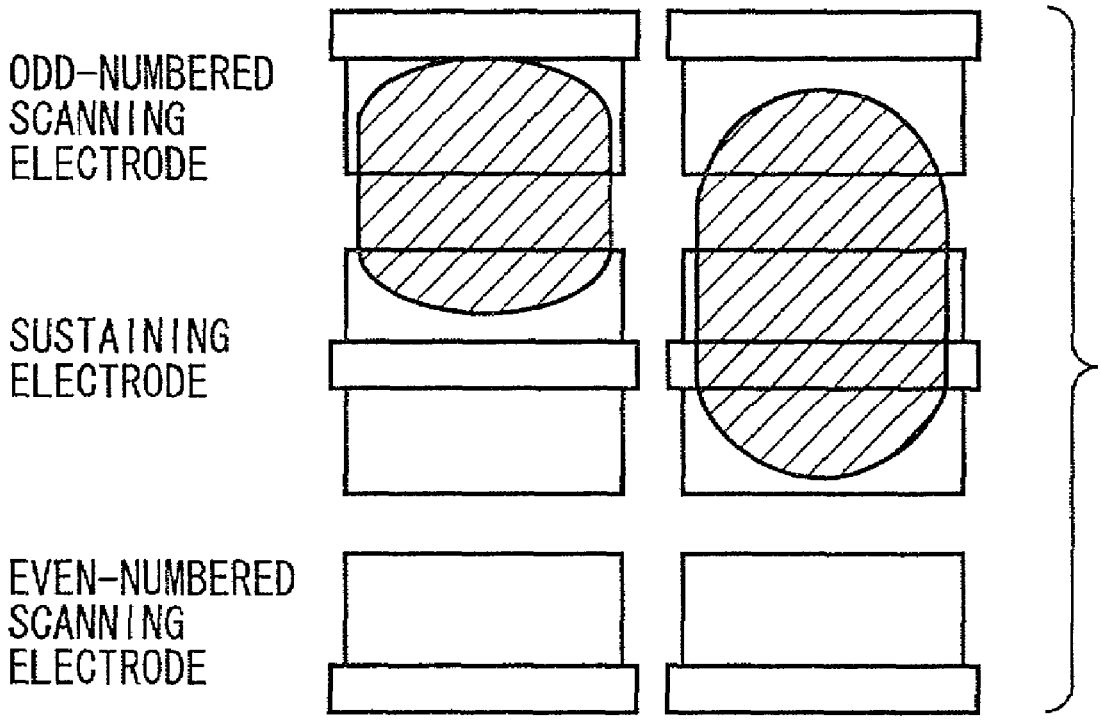
FIGS. 10A and 10B are schematic diagrams showing the mode of emission of the light in the sustaining discharge of the odd-numbered field.

FIGS. 10A and 10B are schematic diagrams showing the mode of emission of the light in the sustaining discharge of the odd-numbered field. The portion marked with hatching shows the area of emission of the light in FIGS. 10A and 10B. FIG. 10A shows the mode of emission of the light during the period that the sustaining pulse a in FIG. 9 is applied to, i.e., during the period that the sustaining electrode is positive. FIG. 10B shows the mode of emission of the light during the period that the sustaining pulse b in the FIG. 9 is applied to, i.e., during the period that the sustaining electrode is negative.

Figures 5A, 5B:
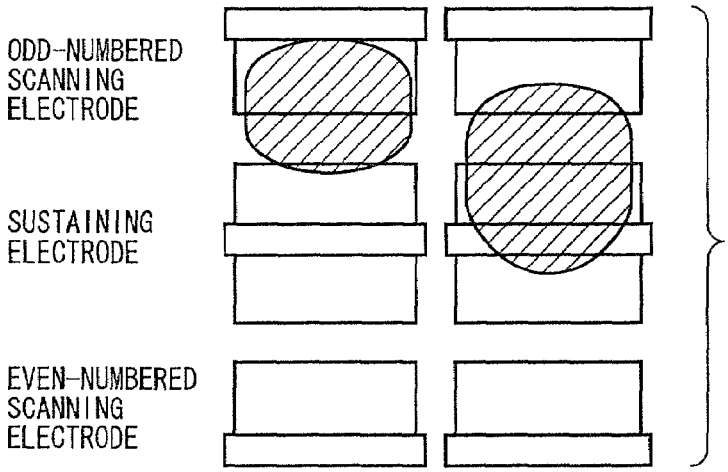
FIG. 5A (PRIOR ART) FIG. 5B (PRIOR ART)
FIGS. 5A and 5B are schematic diagrams showing that only one line is emitted between the odd-numbered scanning electrode and sustaining electrode in the conventional driving sequence in the plasma display panel of the SCS structure.
Figure 6:
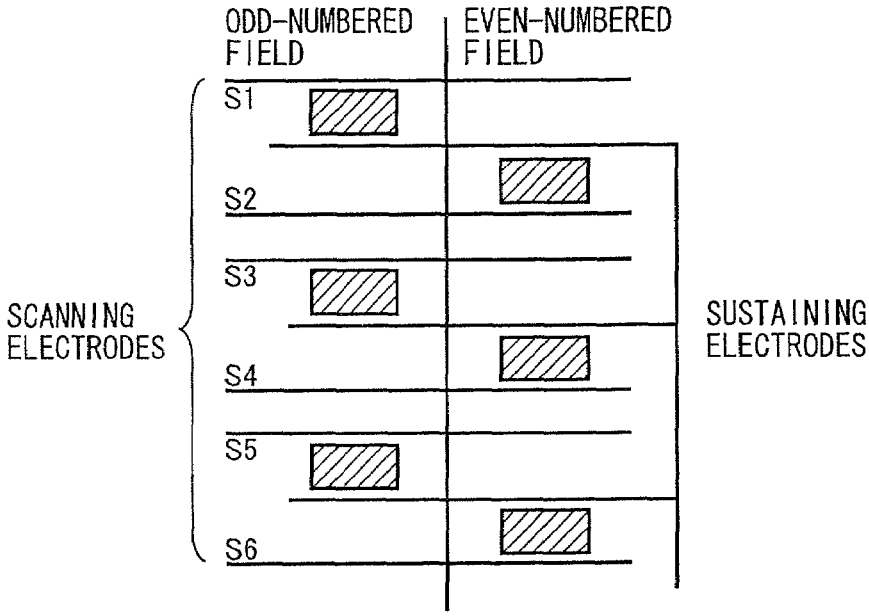
FIG. 6(PRIOR ART)
FIG. 6 is a schematic diagram showing the mode of emission of each display cell in the interlace mode.
Figure 7:
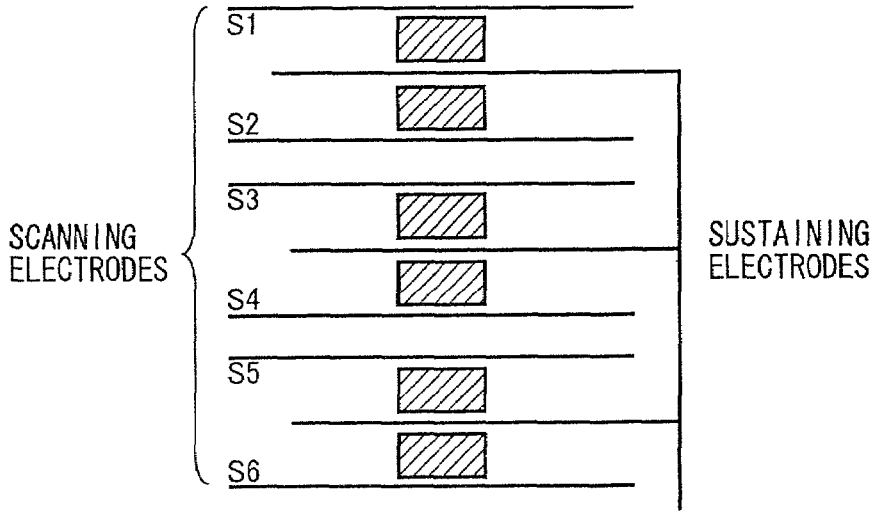
FIG. 7(PRIOR ART)
FIG. 7 shows the case where the plasma display panel of the SCS structure shown in FIG. 3 is operated in accordance with the waveform shown in FIG. 2 in the progressive mode.

As shown in FIG. 10A, the mode of emission of the light when the sustaining electrode is positive is the same as the area of emission of the light in the conventional method shown in FIG. 5A. In the meantime, as shown in FIG. 10B, emission of the light is expanded to the greater part on the sustaining electrode if it is negative. This is because, when the sustaining electrode is positive, i.e., when the negative wall charges are generated in a wide area on the sustaining electrode and the sustaining pulse b is applied to with the sustaining electrode being negative by increasing the width of sustaining pulse a before the sustaining electrode becomes negative, the area of emission of the light on the sustaining electrode is increased.

Next, why there is a difference in the range of the sustaining discharge light emission as in the above will be described below.

If the sustaining pulse a, in which the sustaining electrode is positive, is applied to the negative space charges such as electrons that are generated by the sustaining discharge, the negative space charges are expanded widely along the sustaining electrode as the pulse width is set to be wide. If the sustaining pulse b, in which the sustaining electrode is negative due to such arrangement of charges, is applied then discharging is expanded on the sustaining electrode at the negative side by the space charges expanded along the sustaining electrode when the sustaining pulse a is applied. At this time, negative space charges are not expanded since the width of the sustaining pulse b which is applied to the positive scanning electrode is narrow. Owning to such arrangement of charges, when the next sustaining pulse a, i.e., the sustaining pulse in which the scanning electrode is negative, is applied, the discharge occurring at this time is not expanded as much as the time for the sustaining electrode to become negative.

As described above, it is possible to control the area of emission of the light on the sustaining electrode by changing continuously the width of the pulse that is applied to the sustaining electrode according to the state of negative space charges that are expanded to the sustaining electrode. As described above, in the discharging space having a narrow cell pitch like recent plasma display panels, the ultraviolet light by negative glow discharge occurring near the negative electrode is mainly used. For this reason, it looks as if the display light were expanded to the cell that does not emit the light by increasing the area of discharge when the sustaining electrode is negative. It is then possible to improve brightness as the effective area of emission of the light is expanded.

In the present embodiment, brightness may be increased by expanding emission of the light by the sustaining discharge. It is also possible to improve the luminous efficiency since the current used for emitting light is the same as that in the conventional method.

Figure 11:
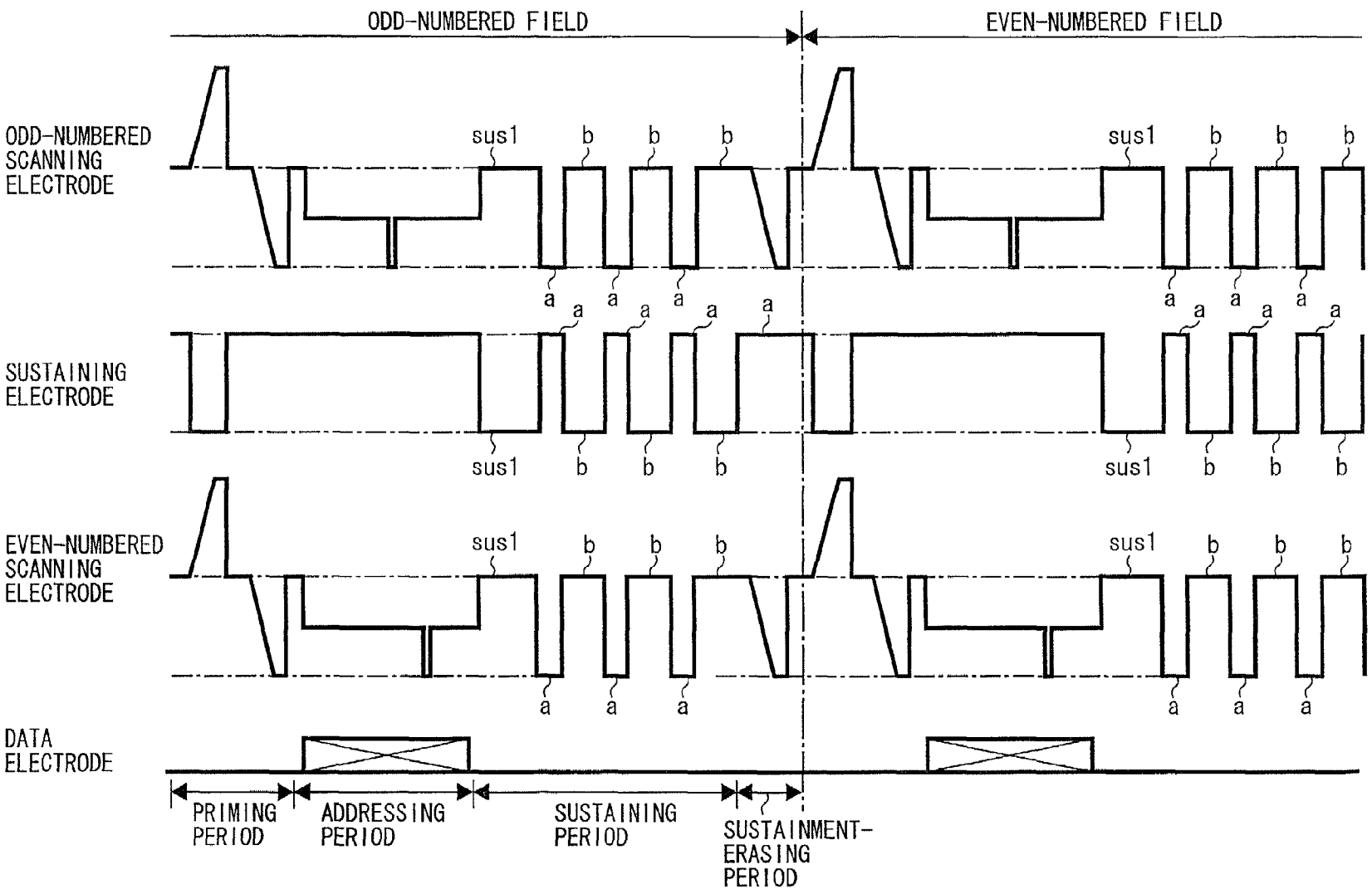
FIG. 11 is a timing chart showing the method for driving a plasma display panel according to the second embodiment of the present invention.

Next, a method of driving a plasma display panel in the progressive method according to a second embodiment of the present embodiment is described. FIG. 11 is a timing chart showing the method for driving a plasma display panel according to the second embodiment of the present invention.

In the present embodiment, as shown in FIG. 11, contrary to the first embodiment, the width of the sustaining pulse b during the time that the sustaining electrode is negative is set to be wide, and that of the sustaining pulse a during the time that the sustaining electrode is positive is set to be narrow.

Figures 8A, 8B:
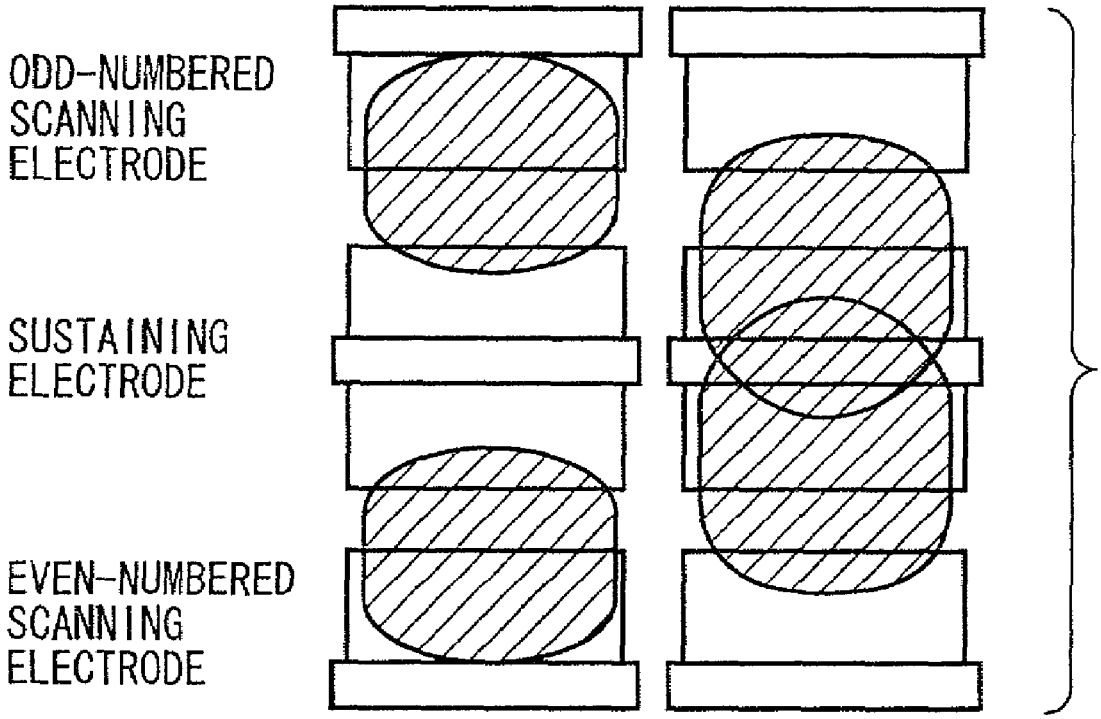
FIG. 8A (PRIOR ART) FIG. 8B (PRIOR ART)
FIGS. 8A and 8B are schematic diagrams showing the mode of emission when the progressive mode is adopted in the plasma display panel of the SCS structure.
Figures 12A, 12B:
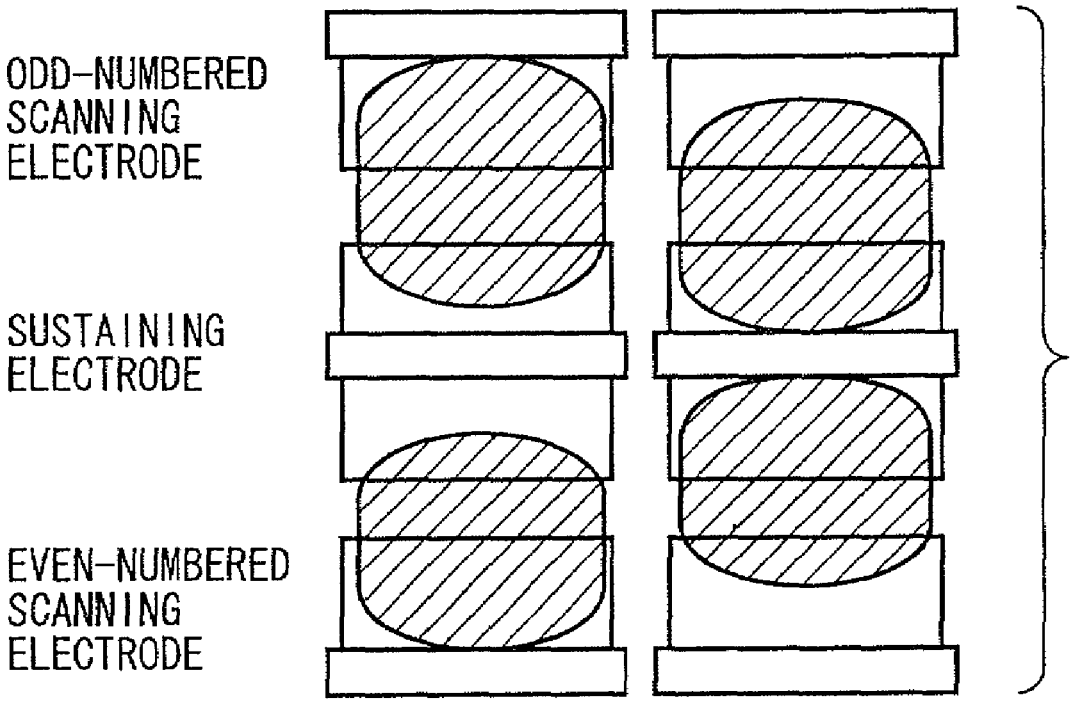
FIGS. 12A and 12B are schematic diagram showing the mode of emission of the light in the second embodiment.

FIGS. 12A and 12B are schematic diagram showing the mode of emission of the light in the second embodiment. The portion marked with hatching in FIGS. 12A and 12B shows the area of emission of the light. FIG. 12A shows the mode of emission of the light during the period that the sustaining pulse a in FIG. 11 is applied to, i.e., during the period that the sustaining electrode is positive. FIG. 12B shows the mode of emission of the light during the period that the sustaining pulse b in FIG. 11 is applied to, i.e., during the period that the sustaining electrode is negative. In FIG. 12B, contrary to the conventional mode of emission of the light shown in FIG. 8B, overlapping of emission of the light in the sustaining electrode does not occur. This is because, contrary to the first embodiment, the range of emission of the light becomes narrower when the sustaining electrode becomes negative since it takes a short time for the sustaining electrode to become positive and the range of expansion of negative charges that are formed on the sustaining electrode becomes narrow. As a result, the boundary becomes more distinct since it is possible to prevent expansion of emission of the light to neighboring cells and emission of the light on the shared electrode, i.e., at the boundary of display lines, the light becomes weaker. Accordingly, it is possible to improve the vertical resolution. Also, it is possible to prevent change of brightness per cell of the corresponding cell according to the state of selection of neighboring cells since no emission of the light is offset by adjacent display lines.

The mode of the sustaining discharge in the above second embodiment is applicable to the interlace method. Although what is sought for in the first embodiment is to improve brightness in the interlace method, it may be required to improve the vertical resolution rather than brightness according to the purpose of use at times. In this case, as described in the second embodiment, it is possible to improve the vertical resolution by increasing the width of sustaining pulse when the sustaining electrode becomes negative and reducing the width of sustaining pulse when the sustaining electrode becomes positive.

Figure 13:
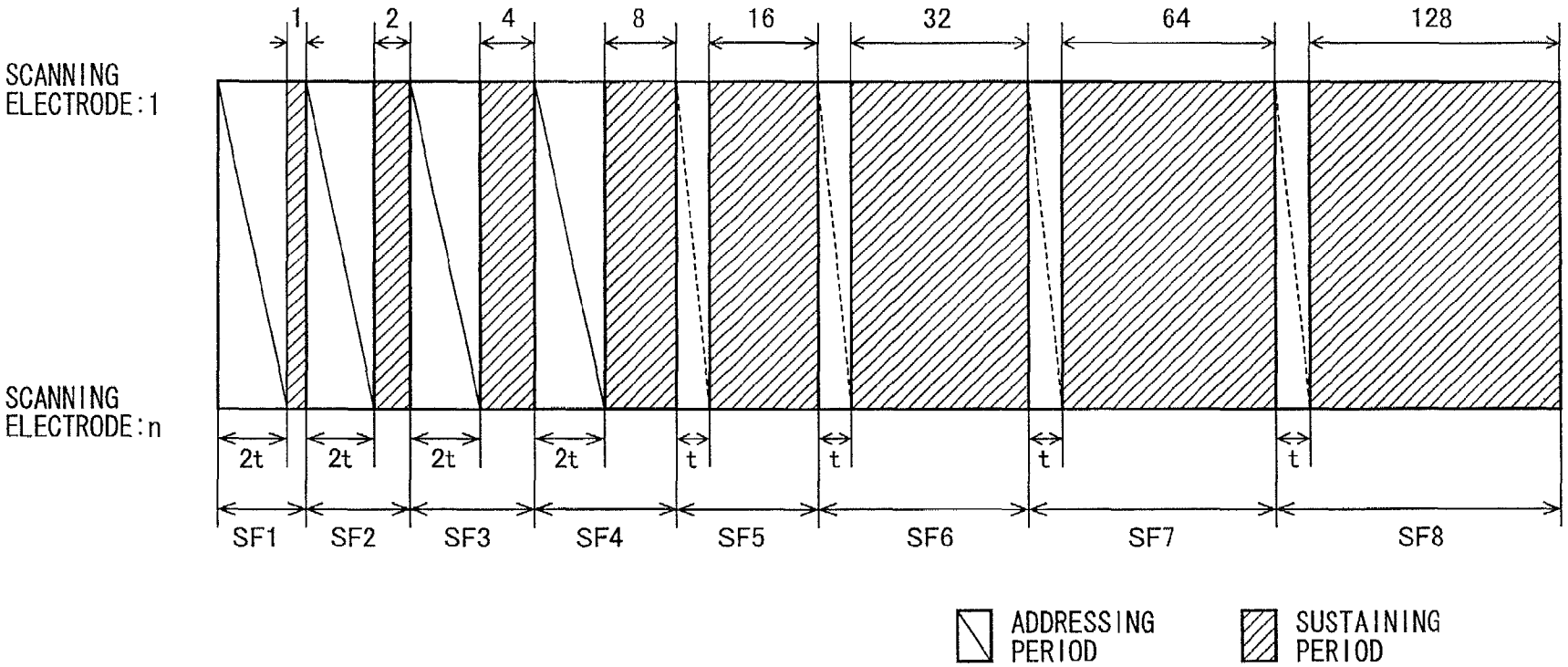
FIG. 13 is a schematic diagram showing the layout of fields in the third embodiment of the present invention.

Illustrated below is a third embodiment of the present invention. FIG. 13 is a schematic diagram showing the layout of fields in the third embodiment of the present invention.

In the third embodiment, any one of the interlace method and progressive method is assigned into each sub-field (hereinafter referred to as SF) in order to improve the luminous efficiency and vertical resolution simultaneously. In FIG. 13, the sub-fields SF1–SF4 having light brightness may be progressive sub-fields, and the sub-fields SF5–SF8 having heavy brightness may be interlace sub-fields in order to mix both methods of display in one field.

The number of scanning electrodes in one sub-field is one half of that of a progressive sub-field and the duration of addressing period becomes t since only one side between the odd-numbered scanning electrode or even-numbered scanning electrode is scanned in each field of an interlace sub-field provided that the duration of addressing period is set to be 2t although all scanning electrodes are scanned in the progressive sub-field.

Figure 14:
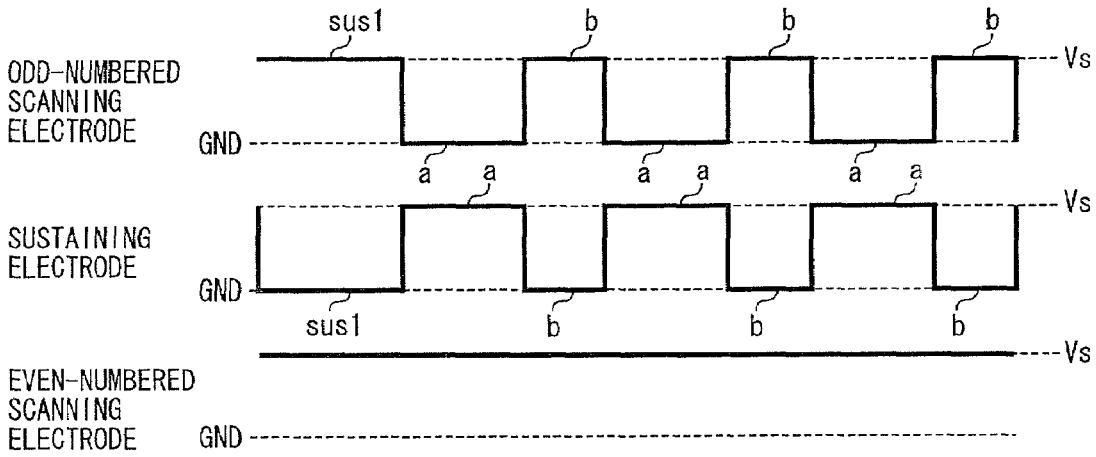
FIG. 14 is a timing chart showing the waveforms of sustaining pulses that are applied to during the period of sustaining of interlace sub-field.
Figure 15:
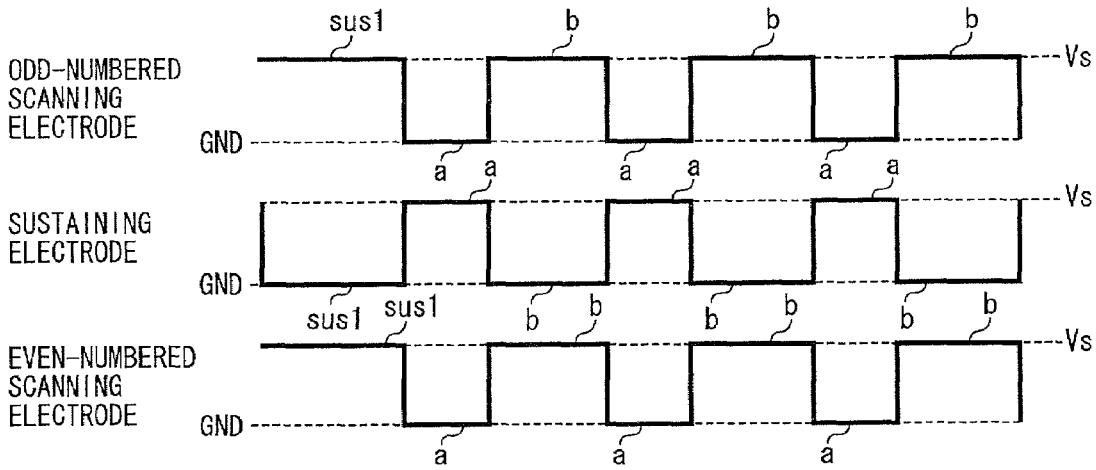
FIG. 15 is a timing chart showing the waveforms of sustaining pulses that are applied to during the period of sustaining of progressive sub-field.

FIGS. 14 and 15 are timing charts showing the waveforms of sustaining pulses that are applied to during the period of sustaining of interlace sub-field and progressive sub-field, respectively. An odd-numbered sub-field is shown in FIG. 14. In order to show an even-numbered sub-field, simply change the waveform of the odd-numbered scanning electrode with that of the even-numbered scanning electrode.

In the sub-fields SF5–SF8 having heavy brightness, as in the first embodiment, it is possible to extend the range of emission of the light when the sustaining electrode becomes negative by increasing the width of sustaining pulse a when the sustaining electrode becomes positive in the interlace method. Also, the addressing period is shortened by the interlace method and the shortened time may be used for the sustaining period. Further, in the sub-fields SF1–SF4 having light brightness, it is possible to reduce the range of emission of the light by increasing the width of sustaining pulse b when the sustaining electrode becomes negative by performing the progressive method. As a result, the boundary between the display cells is distinct, thereby improving the resolution. This enables simultaneous improvement of luminous efficiency and vertical resolution by mixing interlace sub-fields having high brightness and luminous efficiency and progressive sub-fields having a superior vertical resolution.

Still further, in the present embodiment, although the sub-fields having a heavy brightness are interlace driven and the sub-fields having a light brightness are progressively driven, they may be inversely worked according to the purpose of image display.

Figure 16:
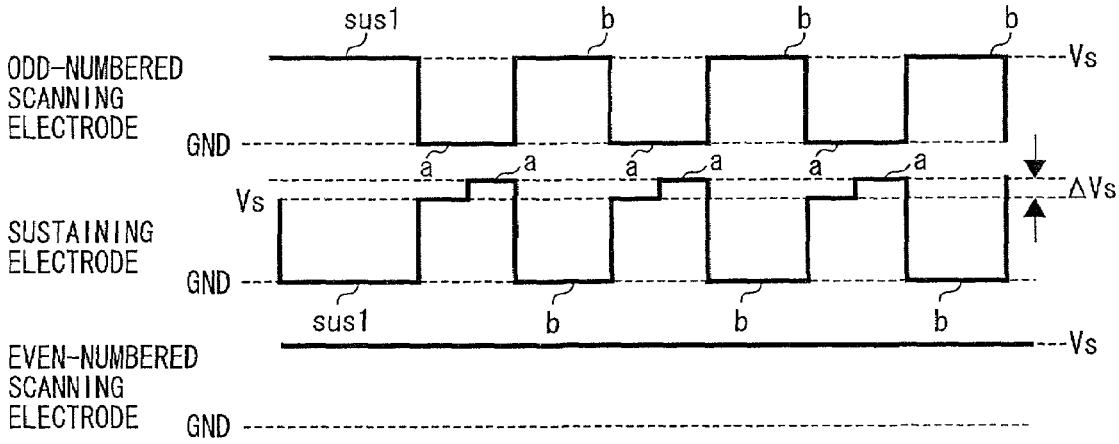
FIG. 16 is a timing chart showing the waveforms of sustaining pulses in an odd-numbered field in the fourth embodiment of the present invention.

Next, a fourth embodiment of the present invention will be described. FIG. 16 is a timing chart showing the waveforms of sustaining pulses in an odd-numbered field in the fourth embodiment of the present invention, where the interlace method is adopted. For an even-numbered field, for the waveforms shown in FIG. 16, it is enough to change the waveform of an odd-numbered scanning electrode with that of an even-numbered scanning electrode.

In the fourth embodiment, the widths of sustaining pulses a and b are equal with each other. However, the potential of the sustaining electrode during the period that the sustaining electrode becomes positive is the reference potential Vs until the sustaining discharge is completed, and it is Vs+ΔVs (ΔVs>0) during the remaining period. That is, the waveforms of sustaining pulse a that is applied to the sustaining electrode have the shape of steps. Sustaining pulses having a fixed amplitude are applied to the scanning electrode. Therefore, the potential difference between the sustaining electrode and scanning electrode is always Vs until the sustaining discharge is completed as the sustaining pulse a in which the sustaining electrode is positive is applied to, and it is Vs+ΔVs thereafter. Also, during the period when the sustaining pulse b in which the sustaining electrode is negative is applied to, the potential difference is maintained as Vs which is constant.

In the present embodiment, it is possible to collect a large number of negative charges that are generated by the sustaining discharge on the sustaining electrode by making the voltage of sustaining pulse a higher than Vs after the sustaining discharge is completed during a period when the sustaining pulse a is applied to as in the first embodiment. That is, according to the fourth embodiment, it is possible to control the charges, which is suppressed by the width of the sustaining pulse in the first embodiment, by the voltage. Then, as in the first embodiment, discharge is expanded widely on the sustaining electrode, and brightness is improved.

Figure 17:
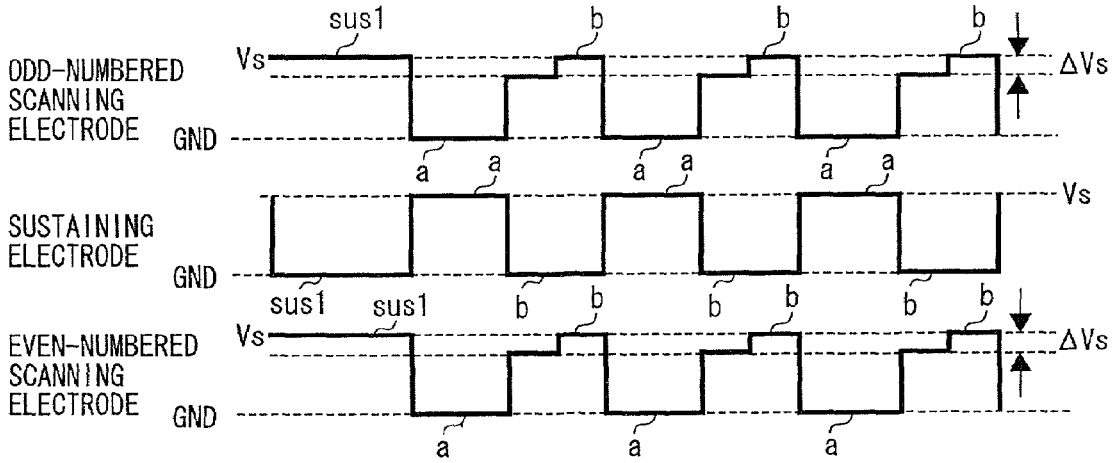
FIG. 17 is a timing chart showing the waveforms of sustaining pulses in the fifth embodiment of the present invention.

Next, a fifth embodiment of the present invention will be described below with reference to FIG. 17. FIG. 17 is a timing chart showing the waveforms of sustaining pulses in the fifth embodiment of the present invention, where the progressive method is adopted.

Also in the fifth embodiment, the widths of sustaining pulses a and b are equal to each other. However, the potential of the scanning electrode during the period that the sustaining electrode becomes positive is Vs−ΔVs until the sustaining discharge is completed, and it is Vs during the remaining period. That is, the waveforms of sustaining pulse b that is applied to the scanning electrode have the shape of steps. Sustaining pulses having a fixed amplitude are applied to the sustaining electrode.

As described in the above, according to the present embodiment, the sustaining charge becomes weak when the sustaining electrode is negative, and emission of the light expanded to the sustaining electrode becomes narrower by lowering the potential difference between the sustaining electrode and scanning electrode during the sustaining discharge to Vs−ΔVs, and raising the potential difference of sustaining pulses to Vs after the sustaining discharge is completed when the scanning electrode is negative. This makes it possible to improve the vertical resolution as in the second embodiment.

The fifth embodiment is also applicable to the interlace method. In this case, as described above, it is possible to improve the vertical resolution although brightness may not be improved.

Further, although expansion of negative charges is suppressed by the width of sustaining pulses in the above third embodiment, in the interlace method, it is possible to suppress the expansion by the voltage of sustaining pulses as in the fourth embodiment in which the voltage of sustaining pulses is raised by ΔVs after the sustaining discharge is completed when the sustaining electrode is positive. Still further, in the progressive method, it is possible to suppress the expansion by the voltage of sustaining pulses as in the fifth embodiment in which the voltage of the sustaining discharge when the scanning electrode is positive is lowered by ΔVs.

Figure 18:
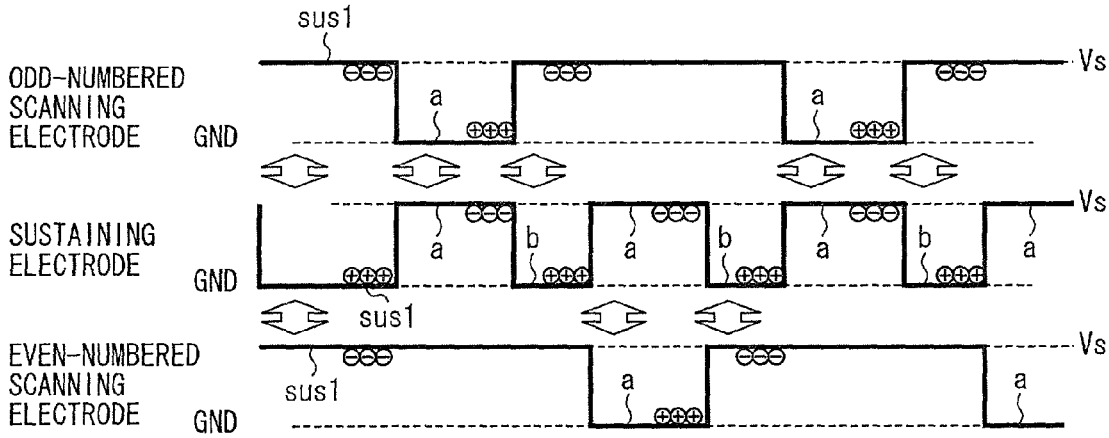
FIG. 18 is a schematic diagram showing the method of driving a plasma display panel in the sixth embodiment.

Next, a sixth embodiment of the present invention is described. FIG. 18 is a schematic diagram showing the method of driving a plasma display panel in the sixth embodiment, where the progressive method is adopted.

In the present embodiment, the sustaining discharge is generated at both sides of a sustaining electrode by setting the width of sustaining pulse sus1 that is applied to the sustaining electrode initially after the addressing period to be wider than those of other sustaining pulses a through d. Thereafter, sustaining pulses are applied to the sustaining electrode continuously, while they are applied to the odd-numbered scanning electrode and even-numbered scanning electrode alternately in case of scanning electrodes. That is, sustaining pulses are applied only to the odd-numbered scanning electrode when the initial set of sustaining pulses a and b is applied to the sustaining electrode after the sustaining pulse sus1 is applied. At this time, the potential of the even-numbered scanning electrode should be the same as that of the sustaining pulse a that is applied to the sustaining electrode. In this way, the sustaining discharge occurs between the odd-numbered scanning electrode and the sustaining electrode, but does not occur between the even-numbered scanning electrode and the sustaining electrode.

Further, as shown in FIG. 18, the width of sustaining pulse a should be set to be wider than that of sustaining pulse b. Then, as in the first embodiment, discharge is expanded to the entire sustaining electrode when the sustaining pulse b is applied to by the effect of negative charges that are expanded as the sustaining pulse a is applied to as shown in FIG. 10B.

The sustaining pulses are applied to only to the even-numbered scanning electrode among all the scanning electrodes when the second set of sustaining pulses a and b is applied to the sustaining electrode after the sustaining pulse sus1 is applied to. At this time, the potential of the odd-numbered scanning electrode should be the same as that of the sustaining pulse a that is applied to the sustaining electrode. In this way, the sustaining discharge occurs between the even-numbered scanning electrode and the sustaining electrode, but does not occur between the odd-numbered scanning electrode and the sustaining electrode. Further, as shown in FIG. 18, the width of sustaining pulse a should be set to be wider than that of sustaining pulse b. Then discharge is expanded to the entire sustaining electrode between the even-numbered scanning electrode and the sustaining electrode.

Thereafter, the sets of sustaining pulses a and b are alternately and repetitively applied as frequently as the size of the sub-field.

In such driving method, the frequency of emission of the light in one field may be reduced by half but brightness in one cycle is increased. For this reason, brightness is not lowered, and the luminous efficiency is improved since the discharging current flowing through the sustaining electrode is reduced by half. Further, there is no problem of actual change of brightness of the corresponding cell according to the state of selection of neighboring cells without offsetting discharge on the sustaining electrode since discharging in the upper and lower display cells is distributed in view of the time as in the interlace method.

In these embodiments, the SCS structure is adopted to the plasma display panel. It is also possible to provide the same effect by applying the method of the present invention to the plasma display panel of the CSC structure in which the shared electrode is the scanning electrode.

What is claimed is:

1. A method for driving a plasma display panel having a plurality of row electrode sets, each including two first electrodes and one second electrode interposed between said first electrodes, the first electrodes and the second electrode respectively acting as scanning electrodes and a sustain electrode, or vice versa, and said second electrode interposed between neighboring display cells such that said second electrode is shared by said neighboring display cells, wherein said neighboring display cells are adjacent in a direction intersecting with a direction where said scanning electrodes and sustaining electrode extend, the method comprising the steps of:

applying sustaining pulses alternately to the neighboring ones of said first and second electrodes; and changing at least one condition selected from the group consisting of pulse width and interval of said sustaining pulses in response to changes in polarity of said sustaining pulses.

2. The method for driving a plasma display panel in which any one of a scanning electrode and a sustaining electrode is shared by neighboring display cells interposed therebetween, the method comprising the step of:

changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode by a predetermined number with relation to an image data during a sustaining period, wherein said changing at least one condition comprises the step of, in case of an interlace method, making a width of said sustaining discharge pulse when said shared electrode functions as a positive electrode wider than that when said shared electrode functions as a negative electrode, and wherein on both sides of one of the sustaining electrode or the scanning electrode, the other one of the sustaining or scanning electrode is arranged, and two of the other one of the sustaining or scanning electrode are arranged between each of the one of the sustaining or scanning electrode.

3. The method for driving a plasma display panel according to claim 2, wherein when the width of said sustaining discharge pulse to be applied to one of said sustaining electrode and said scanning electrode when said electrode functions as a positive electrode is wider than when said electrode functions as a negative electrode, the width of said sustaining discharge pulse to be applied to the other one of said sustaining electrode or said scanning electrode when the other one of the sustaining electrode or the scanning electrode functions as a positive electrode is narrower than when the other electrode of the sustaining electrode or the scanning electrode functions as a negative electrode.

4. The method for driving a plasma display panel in which any one of a scanning electrode and a sustaining electrode is shared by neighboring display cells interposed therebetween, the method comprising the step of:

changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode by a predetermined number with relation to an image data during a sustaining period, wherein said changing at least one condition comprises the step of, in case of an interlace method, making a difference in potential between row electrodes when said shared electrode functions as a positive electrode larger than that when said shared electrode functions as a negative electrode, and wherein on both sides of one of the sustaining electrode or the scanning electrode, the other one of the sustaining or scanning electrode is arranged, and two of the other one of the sustaining or scanning electrode are arranged between each of the one of the sustaining or scanning electrode.

5. The method for driving a plasma display panel in which any one of a scanning electrode and a sustaining electrode is shared by neighboring display cells interposed therebetween, the method comprises the step of:

changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode by a predetermined number with relation to an image data during a sustaining period, wherein said changing at least one condition comprises the step of, in case of an interlace method, making a difference in potential between row electrodes when said shared electrode functions as a positive electrode smaller than that when said shared electrode functions as a negative electrode, and wherein on both sides of one of the sustaining electrode or the scanning electrode, the other one of the sustaining or scanning electrode is arranged, and two of the other one of the sustaining or scanning electrode are arranged between each of the one of the sustaining or scanning electrode.

6. The method for driving a plasma display panel in which any one of a scanning electrode and a sustaining electrode is shared by neighboring display cells interposed therebetween, the method comprising the step of:

changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode by a predetermined number with relation to an image data during a sustaining period, wherein said changing at least one condition comprises the step of, in case of a progressive method, making a width of said sustaining discharge pulse when said shared electrode functions as a positive electrode narrower than that when said shared electrode functions as a negative electrode, and wherein on both sides of one of the sustaining electrode or the scanning electrode, the other one of the sustaining or scanning electrode is arranged, and two of the other one of the sustaining or scanning electrode are arranged between each of the one of the sustaining or scanning electrode.

7. The method for driving a plasma display panel according to claim 6, wherein when the width of said sustaining discharge pulse to be applied to one of said sustaining electrode and said scanning electrode when said electrode functions as a positive electrode is narrower than when said electrode functions as a negative electrode, the width of said sustaining discharge pulse to be applied to the other one of said sustaining electrode and said scanning electrode when the other one of the sustaining electrode and scanning electrode functions as a positive electrode is wider than when the other electrode of the sustaining electrode and scanning electrode functions as a negative electrode.

8. A method for driving a plasma display panel having a plurality of row electrode sets, each of said sets including a pair of first electrodes and a second electrode arranged therebetween, the first electrode and the second electrode respectively corresponding to a scanning electrode and a sustain electrode, or vice versa, and said second electrode interposed between neighboring display cells such that said second electrode is shared by said neighboring display cells, the method comprising step of:

assigning one or more sub-fields with an interlace method in which lines emitting light are changed in each field, and one or more sub-fields with a progressive method in which all lines emit light, in a plurality of sub-fields constituting one field, and wherein said neighboring display cells are adjacent in a direction intersecting with a direction where scanning electrodes and sustaining electrodes extend.

9. The method of driving a plasma display panel according to claim 8, further comprising the steps of:

making a width of said sustaining discharge pulse when said shared electrode functions as a positive electrode wider than that when said shared electrode functions as a negative electrode, in case of said interlace method; and making a width of said sustaining discharge pulse when said shared electrode functions as a positive electrode narrower than that when said shared electrode functions as a negative electrode, in case of said progressive method.

10. The method for driving a plasma display panel according to claim 9, wherein when the width of said sustaining discharge pulse to be applied to one of said sustaining electrode and said scanning electrode when said electrode functions as a positive electrode is wider than when said electrode functions as a negative electrode, the width of said sustaining discharge pulse to be applied to the other one of said sustaining electrode and said scanning electrode when the other one of the sustaining electrode and scanning electrode functions as a positive electrode is narrower than when the other electrode of the sustaining electrode and scanning electrode functions as a negative electrode.

11. The method for driving a plasma display panel in which any one of a scanning electrode and a sustaining electrode is shared by neighboring display cells interposed therebetween, the method comprising the step of:

changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode by a predetermined number with relation to an image data during a sustaining period, wherein said changing at least one condition comprises the step of, in case of an interlace method, making a width of said sustaining discharge pulse when said shared electrode functions as a positive electrode narrower than that when said shared electrode functions as a negative electrode, and wherein on both sides of one of the sustaining electrode or the scanning electrode, the other one of the sustaining or scanning electrode is arranged, and two of the other one of the sustaining or scanning electrode are arranged between each of the one of the sustaining or scanning electrode.

12. The method for driving a plasma display panel according to claim 11, wherein when the width of said sustaining discharge pulse to be applied to one of said sustaining electrode and said scanning electrode when said electrode functions as a positive electrode is narrower than when said electrode functions as a negative electrode, the width of said sustaining discharge pulse to be applied to the other one of said sustaining electrode and said scanning electrode when the other one of the sustaining electrode and scanning electrode functions as a positive electrode is wider than when the other electrode of the sustaining electrode and scanning electrode functions as a negative electrode.

13. The method for driving a plasma display panel in which any one of a scanning electrode and a sustaining electrode is shared by neighboring display cells interposed therebetween, the method comprising the step of:

changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode by a predetermined number with relation to an image data during a sustaining period, wherein said changing at least one condition comprises the step of, in case of a progressive method, making a difference in potential between row electrodes when said shared electrode functions as a positive electrode smaller than that when said shared electrode functions as a negative electrode, and wherein on both sides of one of the sustaining electrode or the scanning electrode, the other one of the sustaining or scanning electrode is arranged, and two of the other one of the sustaining or scanning electrode are arranged between each of the one of the sustaining or scanning electrode.

14. A method for driving a plasma display panel having a plurality of row electrode sets, each including two first electrodes and one second electrode interposed between said first electrodes, the first electrodes and the second electrode respectively acting as scanning electrodes and a sustain electrode, or vice versa, and said second electrode interposed between neighboring display cells such that said second electrode is shared by said neighboring display cells, wherein said neighboring display cells are adjacent in a direction intersecting with a direction where said scanning electrodes and sustaining electrode extend, the method comprising the steps of:

executing sustaining discharge of said neighboring display cells at an interval of one cycle alternately, applying sustaining pulses alternately to the neighboring ones of said first and second electrodes; and changing voltage of said sustaining pulses in response to every change in polarity of said sustaining pulses.

15. The method for driving a plasma display panel according to claim 14, wherein said changing at least one condition comprises the step of making said time width of said sustaining pulses when said shared electrode functions as a positive electrode wider than that when said shared electrode functions as a negative electrode.

16. The method for driving a plasma display panel in which any one of a scanning electrode and a sustaining electrode is shared by neighboring display cells interposed therebetween, the method comprising the steps of:

executing sustaining discharge of said neighboring display cells at an interval of one cycle alternately, and changing at least one condition selected from the group consisting of a voltage of a sustaining pulse, a pulse width of a sustaining pulse, and a pulse applying interval of a sustaining pulse in relation to a polarity of said sustaining pulse, said sustaining pulse being applied to said scanning electrode and sustaining electrode alternately in every cycle by a predetermined number with relation to an image data during a sustaining period, wherein said changing at least one condition comprises the step of making a difference in potential between row electrodes when said shared electrode functions as a positive electrode larger than that when said shared electrode functions as a negative electrode.

17. The method for driving a plasma display panel according to claim 16, wherein when the width of said sustaining discharge pulse to be applied to one of said sustaining electrode and said scanning electrode when said electrode functions as a positive electrode is wider than when said electrode functions as a negative electrode, the width of said sustaining discharge pulse to be applied to the other one of said sustaining electrode and said scanning electrode when the other one of the sustaining electrode and scanning electrode functions as a positive electrode is narrower than when the other electrode of the sustaining electrode and scanning electrode functions as a negative electrode.

18. A method for driving a plasma display panel having a plurality of row electrode sets, each including two first electrodes and one second electrode interposed between said first electrodes, the first electrodes and the second electrode respectively acting as scanning electrodes and a sustain electrode, or vice versa, and said second electrode interposed between neighboring display cells such that said second electrode is shared by said neighboring display cells, wherein said neighboring display cells are adjacent in a direction intersecting with a direction where said scanning electrodes and sustaining electrode extend, the method comprising the steps of:

executing sustaining discharge of said neighboring display cells at an interval of one cycle alternately, applying sustaining pulses alternately to the neighboring ones of said first and second electrodes; and changing at least one condition selected from the group consisting of pulse width and interval of said sustaining pulses in response to changes in polarity of said sustaining pulses.

19. A method for driving a plasma display panel having a plurality of row electrode sets, each including two first electrodes and one second electrode interposed between said first electrodes, the first electrodes and the second electrode respectively acting as scanning electrodes and a sustain electrode, or vice versa, and said second electrode interposed between neighboring display cells such that said second electrode is shared by said neighboring display cells, wherein said neighboring display cells are adjacent in a direction intersecting with a direction where said scanning electrodes and sustaining electrode extend, the method comprising the steps of:

applying sustaining pulses alternately to the neighboring ones of said first and second electrodes; and changing voltage of said sustaining pulses in response to every change in polarity of said sustaining pulses.

* * * * *